United States Patent [19]

Profera, Jr.

[11] Patent Number: 4,757,326

[45] Date of Patent: Jul. 12, 1988

[54] BOX HORN ANTENNA WITH LINEARIZED APERTURE DISTRIBUTION IN TWO POLARIZATIONS

[75] Inventor: Charles E. Profera, Jr., Cherry Hill, N.J.

[73] Assignee: General Electric Company, East Windsor, N.J.

[21] Appl. No.: 30,639

[22] Filed: Mar. 27, 1987

[51] Int. Cl.[4] ..... H01Q 13/02

[52] U.S. Cl. ..... 343/786; 343/772

[58] Field of Search ..... 343/786, 783, 776, 772

[56] References Cited

U.S. PATENT DOCUMENTS

| | | | |
|---|---|---|---|
| 2,617,937 | 11/1952 | VanAtta | 343/786 |
| 3,031,661 | 4/1962 | Moeller et al. | 343/100 |
| 3,380,057 | 4/1968 | Osborn | 343/786 |
| 3,566,309 | 2/1971 | Ajioka | 333/6 |
| 3,696,434 | 10/1972 | Sciambi, Jr. | 343/776 |
| 3,701,163 | 10/1972 | Grabowski | 343/786 |
| 4,667,205 | 5/1987 | Gehin | 343/786 |

FOREIGN PATENT DOCUMENTS

| | | | |
|---|---|---|---|
| 670689 | 9/1963 | Canada | 343/786 |

OTHER PUBLICATIONS

Samuel Silver and Hubert M. James (editors), *Microwave Antenna Theory and Design*, Peter Peregrinus Ltd., London, UK, 1984, Section 10-15, "The Box Horn", pp. 377-380.

*Primary Examiner*—William L. Sikes
*Assistant Examiner*—Michael C. Wimer
*Attorney, Agent, or Firm*—Clement A. Berard, Jr.; William H. Meise

[57] ABSTRACT

An antenna selectively fed from a square waveguide in one of two orthogonal linear $TE_{1,0}$ modes includes a transition between the square waveguide and a larger square horn. A transition arrangement including a plurality of thin conductive elements or vanes is dimensioned and located at the transition to provide a gradual transition between the smaller waveguide dimension and the larger horn dimension in the E plane, and an abrupt transition in the H plane, regardless of the polarization selected. The abrupt transition in the H plane converts some of the $TE_{1,0}$ mode energy to the $TE_{3,0}$ mode. The radiating aperture is at a predetermined distance from the transition arrangement so that the desired relative phase between the $TE_{1,0}$ and $TE_{3,0}$ modes may be established. The E-plane aperture distribution is unaffected by the phasing, but the H-plane aperture distribution can be controlled by selection of the appropriate relative phase in order to provide a more linear distribution than $TE_{1,0}$. The more linear distribution gives higher directive gain.

7 Claims, 6 Drawing Sheets

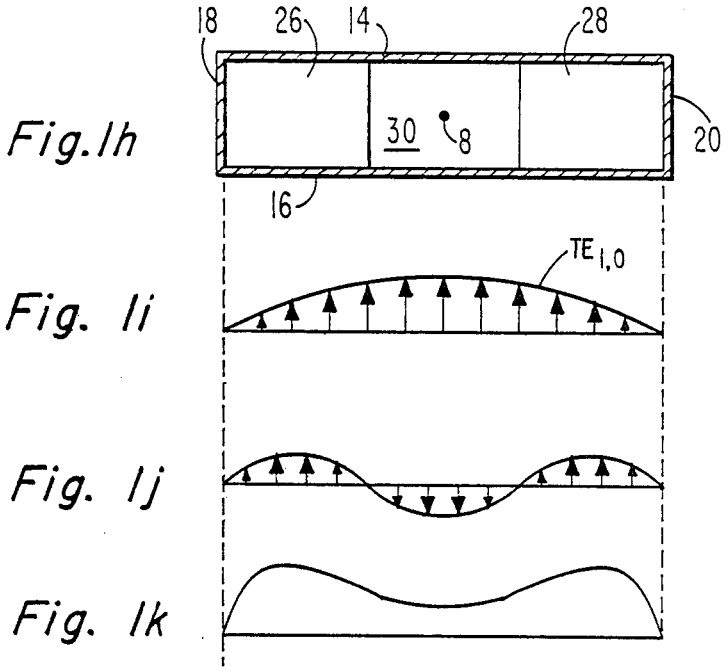
Fig. 1h
Fig. 1i
Fig. 1j
Fig. 1k
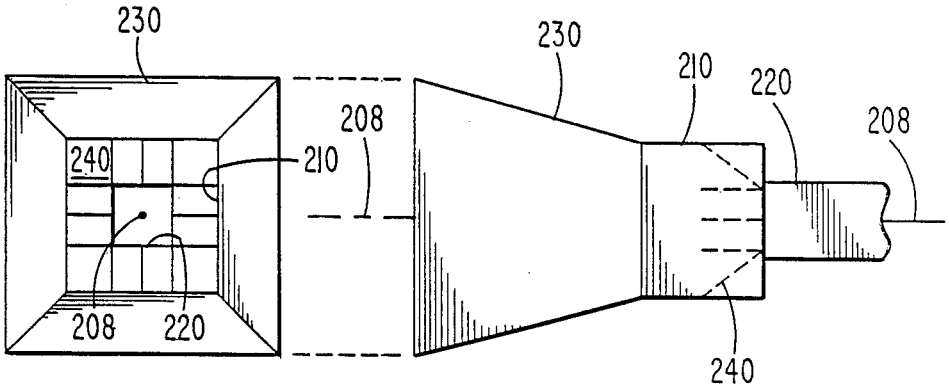
Fig. 2a
Fig. 2b

BOX HORN ANTENNA WITH LINEARIZED APERTURE DISTRIBUTION IN TWO POLARIZATIONS

BACKGROUND OF THE INVENTION

This invention relates to box horn antennas in which the feed waveguide has smaller cross-sectional dimensions than the box horn for inducing higher order modes for linearizing the aperture distribution of the box horn antenna to achieve higher gain.

There are many applications for which antennas having shaped radiation patterns are desirable. For example, shaped beam antennas for communications applications use offset reflectors and multiple element array feeds. For microwave applications, the array feed elements are often in the form of waveguide horns. The gain of a shaped beam reflector antenna is dependent upon the radiation properties of the individual feed horn antenna, which in turn depends upon the illumination of the aperture of the horn.

Those skilled in the antenna arts know that the transmitting and receiving characteristics of an antenna are reciprocal functions. That is, the gain when the antenna is performing a transmitting function is the same as the gain when performing a receiving function. Many other antenna characteristics are also identical in both transmitting and receiving modes, but the descriptions are often couched only in terms of transmission. The illumination of an aperture may be thought of as the energy density distribution at the radiating opening (alternatively at the energy-collecting opening) of the antenna. In a horn antenna the radiating aperture is normally the large open end, corresponding to the open end of a trumpet. Thus, the illumination is the electromagnetic energy distribution within the opening of the horn.

As mentioned, the radiated beam shape depends upon the aperture illumination or distribution. It is well known that a relatively large aperture is capable of producing a relatively narrow radiated beam. Such a narrow radiated beam corresponds to an antenna having high directivity, and is ordinarily associated with high antenna gain. High gain or high directivity is a desirable characteristic of antennas used as feeds for reflectors. It is easy to understand that if an antenna has a large aperture, but most of the aperture is unused because the aperture illumination or distribution is such as to put little or no energy in a major portion of the aperture, that the useful or effective aperture is smaller than it would be if the illumination were uniform. For this reason, aperture illumination distributions which concentrate the energy in a small portion of the aperture, or in which the aperture distribution is other than uniform, result in a relatively wide radiation pattern, relatively low directivity and relatively low gain (although they may have other desirable properties such as low sidelobe levels). Such antennas may be less desirable for use as feed array elements for reflector-type antennas.

SUMMARY OF THE INVENTION

An antenna includes a box horn having a rectangular cross-section of predetermined dimensions. The box horn is fed at a junction including a rectangular mouth from a rectangular waveguide having cross-sectional dimensions smaller than the dimensions of the box horn. In one embodiment of the invention, the box horn, the mouth and the waveguide have square cross-sections.

Energy can flow in a $TE_{1,0}$ mode in the square waveguide in either of two polarizations. At the junction, the square waveguide opens abruptly into the box horn in vertical and horizontal dimensions. A transition arrangement includes at least four conductive strips, each of which extends from an edge of the mouth to the nearest wall of the box horn. This creates a gradual transition in the E plane for either linear polarization of the propagating energy, and a corresponding abrupt transition in the H plane. A particular embodiment includes a square pyramidal horn coupled to the aperture of the box horn.

DESCRIPTION OF THE DRAWING

FIGS. 1*a*–1*k*, referred to jointly as FIG. 1, illustrate and explain the operation of a prior art box horn antenna, and more particularly FIG. 1*a* is a perspective view, partially cut away, of a box horn and a portion of its feed waveguide, FIG. 1*b* is a cross-section of the waveguide portion of the arrangement of FIG. 1*a*, and FIG. 1*c* illustrates the energy distribution in the cross-section of FIG. 1*b*, FIGS. 1*d* and 1*h* are cross-sections at different locations of the structure of FIG. 1*a*, and FIGS. 1*e*, 1*f*, 1*g*, 1*i*, 1*j* and 1*k* are representations of two of the possible energy distributions in the cross-sections of FIGS. 1*d* and 1*h*;

FIGS. 2*a* and 2*b*, referred to jointly as FIG. 2, are aperture-end and side views, respectively, of an antenna embodying the invention;

DESCRIPTION OF THE INVENTION

Figure 1A:
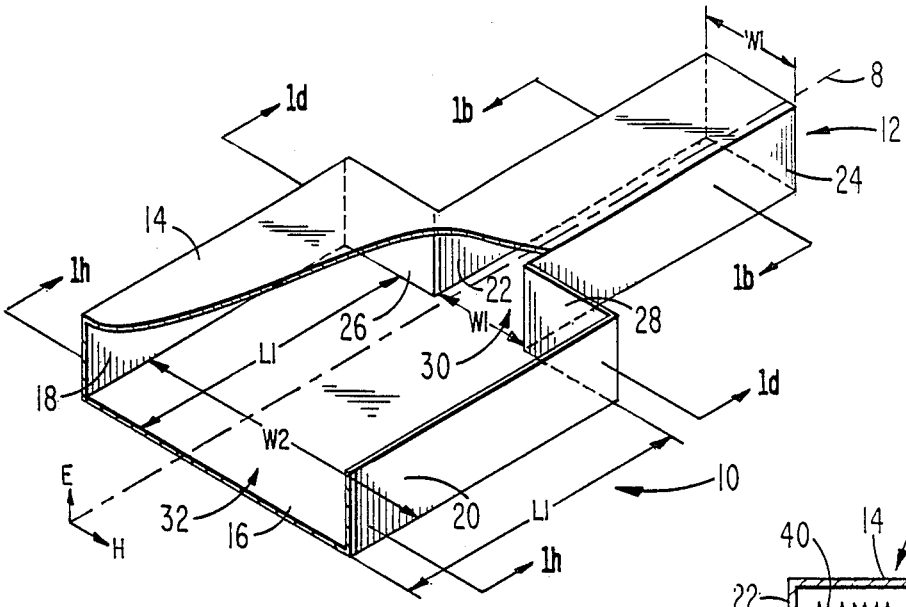
Fig. 1a PRIOR ART

FIG. 1*a* is a perspective view, partially cut away, of a prior art basic box horn antenna 10 fed from a rectangular waveguide 12. Horn antenna 10 includes conductive upper and lower walls 14 and 16, and conductive side walls 18 and 20 separated by a distance $W_2$. The top and bottom walls of waveguide 12 are continuations of upper and lower box horn walls 14 and 16, respectively. Feed waveguide 12 includes conductive side walls 22 and 24, which are separated by a distance $W_1$, which is substantially smaller than distance $W_2$ separating walls 18 and 20 of box horn 10. The walls of wall pairs 14, 16; 18, 20; and 22, 24 are equidistant from a central or longitudinal axis 8. Additional conductive wall 26 connects walls 18 and 22, and conductive wall 28 connects walls 20 and 24. The structure as so far described allows energy flowing through waveguide 12 towards box horn 10 to enter box horn 10 through a rectangular mouth or aperture 30. Energy entering box horn 10 through mouth 30 is coupled to a rectangular open or radiating aperture 32 defined by walls 14, 16, 18 and 20.

Figure 1B:
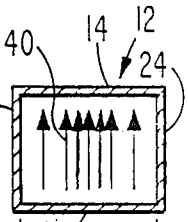

As so far described, the horn antenna is similar to that described by Van Atta in U.S. Pat. No. 2,617,937 issued Nov. 11, 1952. As therein described, rectangular feed waveguide 12 is dimensioned to propagate electromagnetic energy in a $TE_{1,0}$ mode. FIG. 1*b* illustrates a cross-section of waveguide 12 at section line b—b. As is well known to those skilled in the art, a $TE_{1,0}$ mode is a waveguide propagating mode in which the electric field is transverse and the electric field lines are parallel to the shorter walls of the waveguide. The electric field lines, one of which is illustrated as 40 in FIG. 1*b*, extend between broad walls 14 and 16, and therefore have a linear density distribution in the vertical direction. Minimum beamwidth is therefore available in a vertical plane. In the horizontal direction, the electric field lines have a density distribution which is a maximum midway between the narrow conductive walls 22 and 24, as suggested by the greater density of electric field lines 40 in FIG. 1*a*.

Figure 1C:
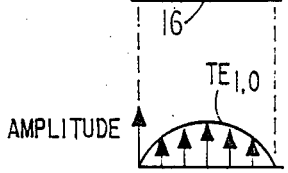

FIG. 1*c* is an amplitude-versus-position plot of the electric field distribution in waveguide 12 at the cross-section of FIG. 1*b*. The electric field intensity is zero at the left and right extremes because the electric field cannot exist parallel to conductive side walls. As also described in the Van Atta patent, the discontinuity in widths between feed waveguide width $W_1$ and box horn width $W_2$ near mouth 30 results in the conversion of some of the propagating electromagnetic energy from the $TE_{1,0}$ mode to the $TE_{3,0}$ mode. The relative amounts of $TE_{1,0}$ and $TE_{3,0}$ components depends upon the relative sizes of $W_1$ and $W_2$. Thus, at a section line d—d lying between mouth 30 and radiating aperture 32, both the $TE_{1,0}$ and $TE_{3,0}$ modes coexist.

Figure 1D:
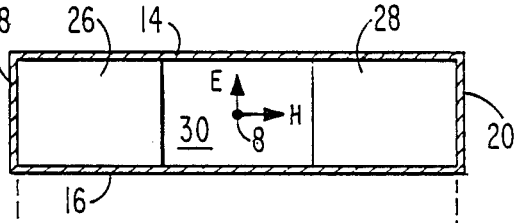

FIG. 1*d* is a cross-section of box horn 10 of FIG. 1*a* taken at section lines d—d of FIG. 1*a*. In FIG. 1*d*, an arrow E points in a direction parallel with the electric field lines. Arrow E directed parallel to the electric field lines and axis 8 together define a plane which is known as the "E" plane. Similarly, an arrow H at right angles to arrow E defines, together with axis 8, a plane which, together with all planes parallel thereto, is known as the "H" plane.

Figure 1E:
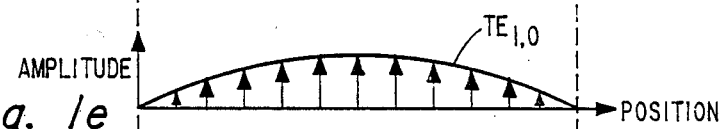
Figure 1F:
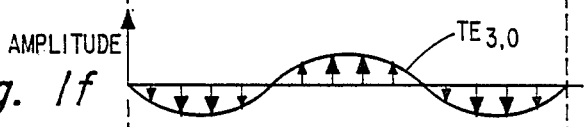
Figure 1G:
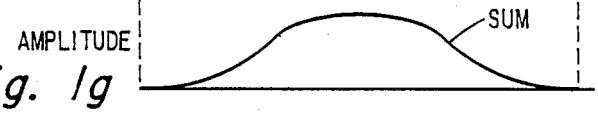

FIG. 1*e* includes a series of arrows of varying length which illustrate the relative amplitude distribution of the $TE_{1,0}$ mode, which is similar to that illustrated in FIG. 1*c*. FIG. 1*f* illustrates, also by a series of arrows, the energy distribution of the $TE_{3,0}$ mode. As illustrataed, the amplitude of the $TE_{3,0}$ mode has three peaks (one positive, two negative) associated with the three half-cycles of distribution in the H direction or in the H plane. The central peak as illustrated in FIG. 1*f* has its arrows pointed in the same direction as the arrows representing the $TE_{1,0}$ mode in FIG. 1*e*, thereby indicating an in-phase condition between the $TE_{1,0}$ and $TE_{3,0}$ mode at a location centered between the narrrow walls 18, 20. The two peak amplitude portions of the $TE_{3,0}$ mode distribution nearest narrow walls 18 and 20 as illustrated in FIG. 1*f* have their arrows pointing in the opposite direction from the $TE_{1,0}$ arrows of FIG. 1*e*, thereby indicating an out-of-phase condition. Thus, at a point near mouth 30 within box horn 10, the sum field distribution (the sum of the $TE_{1,0}$ and $TE_{3,0}$ modes) has maximum amplitude centered between walls 18 and 20, falling off rapidly near the edges, as illustrated in FIG. 1*g*. Such an amplitude distribution is undesirable for making maximum use of radiating aperture 32.

As described in the Van Atta patent, the two modes have different wavelengths in the box horn so that their relative phase at radiating aperture 32 depends upon the length $L_1$ of the box horn from mouth 30 to a point near the opening of radiating aperture 32. FIG. 1*h* is a cross-section of box horn 10 along section line h—h of FIG. 1*a*, which is at or near radiating aperture 32, which is at a distance $L_1$ from the plane which includes mouth 30, and conductive walls 26 and 28. FIG. 1*i* illustrates the $TE_{1,0}$ mode electric field amplitude distribution at the cross-section of FIG. 1*h*. The distribution is similar to that of FIG. 1*c*. FIG. 1*j* illustrates the amplitude distribution of the $TE_{3,0}$ mode electric field at the cross-section of FIG. 1*h*, and its phase relative to the distribution of FIG. 1*i*. It will be noted that the phase of the $TE_{3,0}$ mode electric field is reversed relative to that illustrated in FIG. 1*f*. This phase reversal results in a sum electric field distribution as illustrated in FIG. 1*k* which is much more constant than that illustrated in FIG. 1*g*. Since the cross-section of FIG. 1*h* is at or near the radiating aperture 32, the sum distribution of FIG. 1*k* represents the aperture distribution. This aperture distribution is much more linear or more constant than an unmodified $TE_{1,0}$ distribution, and provides greater directivity and more gain.

The distance $L_1$ required is that distance which causes a differential phase shift of 180° between the $TE_{1,0}$ and $TE_{3,0}$ modes. While the distance $L_1$ between mouth 30 and radiating aperture 32 in the arrangement of FIG. 1*a* as illustrated and described gives a differential phase shift of 180° or $\lambda/2$, other lengths are possible. Those lengths which are useful are those in which the relative phases of the $TE_{1,0}$ and $TE_{3,0}$ modes produce a sum energy distribution at the radiating aperture which is substantially linear across the aperture, decreasing sharply at the edges.

It is often desired that an antenna have the capability of responding to circular polarization, or equally to two orthogonal linear polarizations. In either case, the antenna must produce substantially the same gain for two orthogonal linear polarizations. The arrangement of FIG. 1 does not possess the symmetry required to produce the $TE_{10}$ and $TE_{30}$ mode for orthogonal polarizations. Even if it did possess this symmetry, the E-plane step would give rise to an additional higher order mode pair ($TE_{1,2}$ and $TM_{1,2}$) which would preclude the field uniformity of the $TE_{1,0}$ and $TE_{3,0}$ modes alone.

FIG. 2*a* is a view looking into the radiating aperture of a horn antenna according to the invention, and FIG. 2*b* is a side view thereof. The antenna illustrated in FIG. 2*a* includes a box horn 210 having a square cross-section, and a square feed waveguide 220, which in FIG. 2*b* is illustrated as being truncated. Additionally, the antenna illustrated in FIG. 2 includes a pyramidal horn portion 230 which can be used for increasing the aperture size for increasing the gain. Pyramidal portion 230 is not central to the invention, but may be used if desired. The antenna is centered on an axis 208. Located within box horn section 210 near the junction of box horn 210 and waveguide 220 are a plurality of conducting vanes designated together as 240. Vanes 240 are arranged so that $TE_{1,0}$ mode electromagnetic energy or signal propagating in square waveguide 220 encounters a step transition or change in size in the H plane upon entering box horn 210, without encountering a step transition in the E plane, regardless of the polarization of the $TE_{1,0}$ mode signal.

FIG. 3 is a perspective view, partialy cut away, of that portion of the antenna of FIG. 2 including box horn 210 and square waveguide 220. Elements of the arrangement of FIG. 3 corresponding to those of FIG. 2 are designated by the same reference numeral. Box horn 210 of FIG. 3 has a rectangular cross-section in a plane orthogonal to axis 208, and is defined by conductive side walls 318 and 320, top wall 314', and bottom wall 316'. Each side of the cross-section of square box horn 210 has dimensions of about 3/2 free-space wavelength at a frequency within the operating frequency band. Square waveguide 220 is also centered on axis 208, and is defined by upper wall 314, lower wall 316, and side walls 322 and 324.

A conductive plate 326 is connected to walls 314', 316', 318 and 320 of box horn 210, and lies in a plane orthogonal to axis 208. Those skilled in the art realize that plate 326 (and other planar elements) has finite dimensions and cannot actually lie in a plane, but such flat elements may be treated as being planar for ease of description. A square central aperture in plate 326 has sides which are parallel to the outer edges of plate 326. The central aperture in plate 326 has dimensions equal to the inside cross-sectional dimensions of square waveguide 220. Square waveguide 220 is connected to plate 326 at the central aperture in plate 326, so that the central aperture forms a continuation of the inner dimensions of waveguide 220 into box horn 210, thereby defining a square mouth 330 by which energy flowing in waveguide 220 towards box horn 210 is coupled into the box horn. Since the central aperture in plate 326 is, as a practical matter, almost indistinguishable from the mouth of waveguide 220, the central aperture is also designated 330. Central aperture 330 has left and right edges 341 and 344, respectively, and top and bottom edges 342 and 346. The interior cross-sectional dimensions of box horn 210 are larger than the interior cross-sectional dimensions of square waveguide 220, so that a step transition in dimensions occurs at mouth 330 in vertical and horizontal directions. The vertical and horizontal directions are indicated by the arrows designated VERT and HORIZ adjacent axis 208.

Square waveguide 220 is capable of propagating energy into $TE_{1,0}$ mode within an operating range of frequencies for either of two orthogonal linear polarizations, namely with the electric field vertical or with the electrical field horizontal. As described below, a transition arrangement 240 including a set of conductive vanes or fins 376–398 provides a gradual transition in the E plane and an abrupt transition in the H plane, regardless of which of the two polarizations is propagated. With this arrangement, a $TE_{3,0}$ mode can be set up in box horn 210 and phased so as to provide a substantially linear aperture energy distribution in the H plane regardless of the polarization of the incident energy.

Transition arrangement 240, as mentioned, includes conductive fins or vanes 376, 378, 380, 382, 384, and 386, which have the shape of a planar right triangle with two bases and a hypotenuse, and with three vertices, and which are oriented in a vertical plane. Vane 376 lies in a vertical plane. One edge, constituting a base of the triangular shape of vane 376, is in contact with conductive plate 326, and another base of the triangle is in contact with conductive upper wall 314'. One corner or vertex of triangular vane 376 is adjacent the upper left corner of central aperture 330, and the hypotenuse of the triangular shape of vane 376 extends from the upper left corner of central aperture 330 to a point on wall 314' of box horn 210. Another vane 380 is identical in size and shape to vane 376, and is parallel therewith, and similarly has its bases in contact with plate 326 and with wall 314' of box horn 210, but has one of its vertices located adjacent the upper right corner of central aperture 330, as viewed in FIG. 3. Conductive vane 378 is identical in size and shape to vanes 376 and 380, and is located halfway between vanes 376 and 380, with one vertex adjacent upper edge 342 of central aperture 330.

Similarly, three additional vanes 382, 384 and 386 are located near the bottom of central aperture 330. Vane 382 is similar in shape to vane 380, and lies in the same vertical plane as vane 380. The bases of vane 382 lie against and are fastened to conductive plate 326 and bottom wall 316'. The hypotenuse of vane 382 extends from the lower right corner of central aperture 330 to a point along bottom wall 316'. Another triangular vane 386 has the same shape and lies in the same plane as vane 376, and has bases fastened to plate 326 and to wall 316', and has a hypotenuse which extends from the lower left corner of central aperture 330 to a point on wall 316'. A vane 384 has the same shape as and lies in the same plane as vane 378. Vane 384 is also fastened to plate 326 and bottom wall 316' and has a hypotenuse which extends from the center of edge 346 of central aperture 330 to a point on wall 316'.

Transition arrangement 240 further includes two sets of conductive vanes 388–398, each in the form of a right triangle, the plane of which is disposed horizontally. The first set of vanes includes vanes 388, 390 and 392, and the second set includes vanes 394, 396 and 398. Vanes 388, 390 and 392 each have one base in contact with conductive plate 326, and another base in contact with side wall 320 of box horn 210. An edge corresponding to the hypotenuse of each of vanes 388, 390 and 392 extends from a point along edge 344 of central aperture 330 to a point along side wall 320. A vertex of vane 388 is adjacent the upper right corner of central aperture 330, and a vertex of vane 392 is adjacent the lower right corner of central aperture 330. The corresponding vertex of vane 390 is located at a centrally located point along edge 344 of central aperture 330.

Triangular vanes 394, 396, 398 are coplanar with vanes 388, 390 and 392, respectively. Bases of each of vanes 394, 396 and 398 are in contact with plate 326 and with side wall 318. A hypotenuse of each of vanes 394, 396 and 398 extends from edge 341 of central aperture 330 to a point along side 318.

Figure 3A:
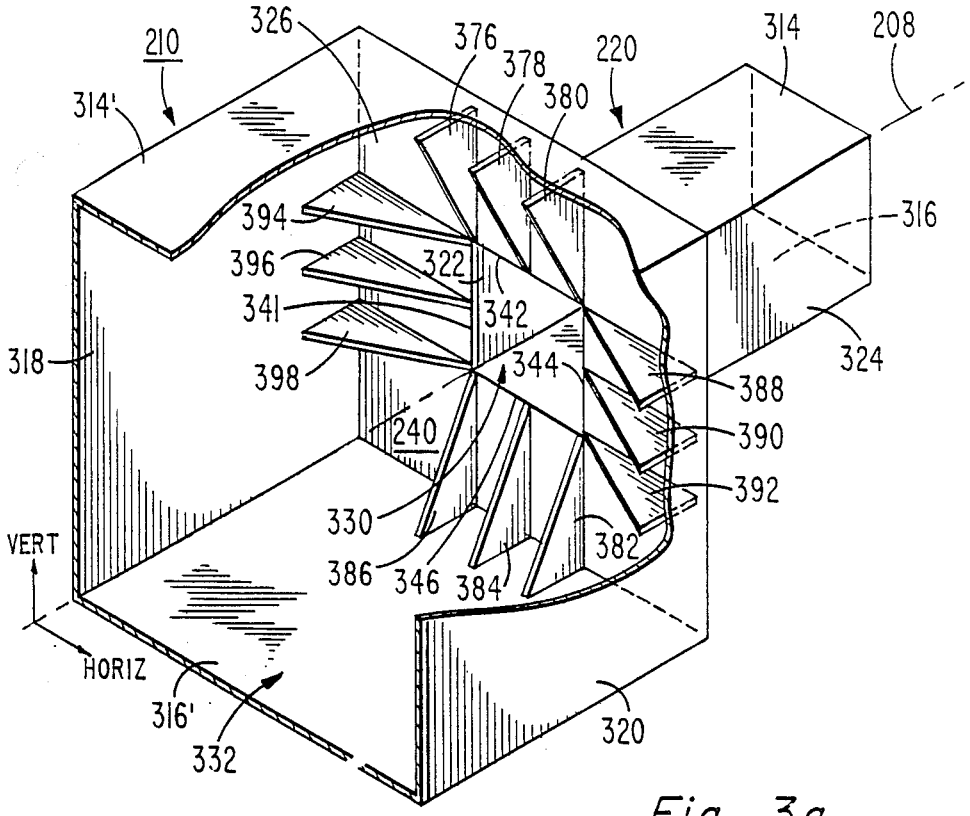
FIG. 3*a* is a perspective view, partially cut away, of a portion of the antenna of FIG. 2 illustrating details of a mode transition including a plurality of flat, thin conductors.
Figure 3B:
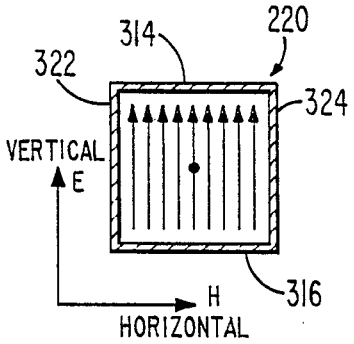
FIGS. 3*b* and 3*c* illustrate a cross-section of the feed waveguide for the antenna of FIG. 3*a* illustrating the electric field distribution in two different polarizations.

FIG. 3*b* illustrates a cross-section of square waveguide 220, illustrating its orientation relative to vertical and horizontal directions, for reference. Within the illustrated cross-section, the electric field lines are illustrated by arrows. The electric field lines terminate on conductive sides 314 and 316. Since the propagation within waveguide 220 is in the $TE_{1,0}$ mode, the density of the electric field lines is greater midway between walls 322 and 324 and, because the electric field lines cannot exist parallel with conductive walls 322 or 324, the distribution is zero adjacent those walls. For the illustrated linear polarization, the vertical direction corresponds to the E plane and the horizontal plane corresponds to the H plane. This polarization will be termed "vertical".

Figure 3C:
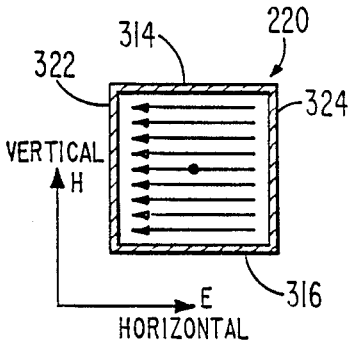

FIG. 3*c* illustrates the same cross-section as FIG. 3*b*, but with a linear polarization which is orthogonal to that of FIG. 3*b*. As illustrated in FIG. 3*c*, the electric field lines are horizontal, and terminate on conductive walls 322 and 324. Consequently, the horizontal plane is the E plane, and the vertical plane is the H plane. This polarization will be termed "Horizontal".

Referring once again to FIG. 3*a*, transition arrangement 240 as illustrated provides a gradual transition in the E plane and an abrupt transition in the H plane regardless of the polarization of the $TE_{1,0}$ mode energy propatating in waveguide 220. In the event that the energy propagates with vertical polarization as illustrated in FIG. 3*b*, the ends of the electric field lines couple onto vanes 376–386 and "ride" the hypotenuse edges of the vanes along a gradually diverging path which "stretches" the electric field lines gradually to couple the electric field lines to conductors 314' and 316' of box horn 210.

In the case of reception, of course, the electric field lines ride the hypotenuse edges along a gradually converging path which shrinks the field lines. Thus, for vertical polarization, vertically disposed vanes 376–386 act as a tapered transition and horizontally disposed vanes 388–398 have no effect whatever, i.e. they are "invisible". Thus, the structure illustrated is tantamount to an abrupt transition in the H plane for vertical polarization, which, as described in conjunction with FIG. 1, results in conversion of some of the energy from the $TE_{1,0}$ mode to the $TE_{3,0}$ mode. As also described in conjunction with the prior art antenna of FIG. 1*a*, the resulting aperture distribution is such as to efficiently utilize the available aperture 332 to achieve high gain.

For energy propagating in waveguide 220 which is horizontally polarized as illustrated in FIG. 3*c*, the electric field lines couple onto the edges of vanes 388–398 and make a gradual transition to sides 318 and 320, while vanes 376–386 are invisible. Thus, horizontally-polarized energy propagating in waveguide 220 encounters a gradual transition in the E plane and an abrupt transition in the H plane, just as in the case of vertical polarization. Also as in the vertically-polarized case, the abrupt transition in the H plane converts some of the energy from the $TE_{1,0}$ mode to the $TE_{3,0}$ mode, thereby producing an energy distribution at aperture 332 which efficiently utilizes the aperture.

The arrangement of FIG. 3*a*, therefore, radiates (or receives) in either of two linearly-polarized modes with identical aperture distributions, and therefore has similar gain characteristics for the two polarizations.

Figure 4:
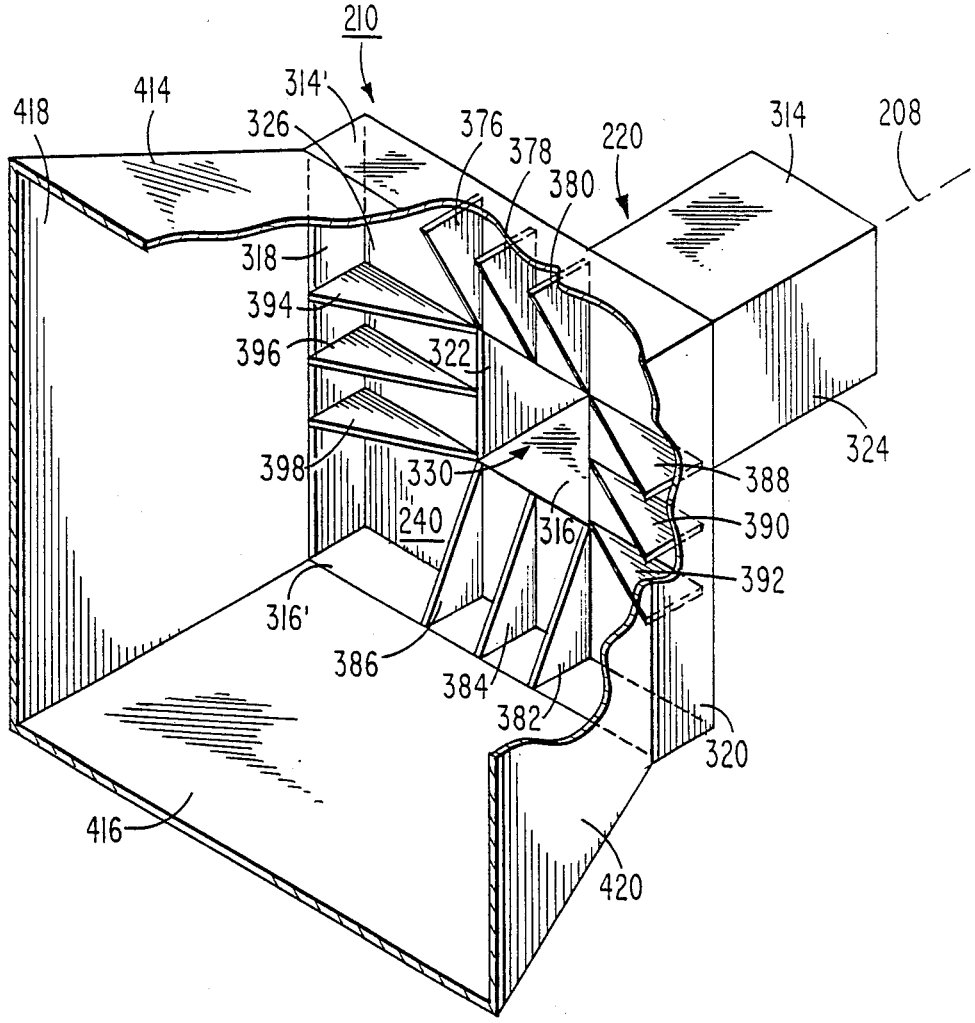
FIG. 4 is a perspective view, partially cut away, of another antenna embodying the invention, including a flared horn section.

The arrangement of FIG. 4 is very similar to the arrangement of FIG. 3*a*, and elements corresponding to those of FIG. 3*a* are designated by the same reference numerals. The arranqement of FIG. 4 differs from that of FIG. 3*a* by including a pyramidal horn having the sides 414, 416, 418 and 420 which are coupled to a foreshortened box horn 210 immediately adjacent transition arrangement 240. The use of such a pyramidal horn allows the magnitude of the directivity and gain to be adjusted. As described in conjunction with the arrangement of FIG. 1*a*, the length of the pyramidal horn must be selected to provide proper phasing between the $TE_{1,0}$ and the $TE_{3,0}$ propagating modes. The taper of the horn should be gradual to maintain substantially plane phase wavefronts. The walls of the horn may lie along extensions of the hypotenuses of the vanes for best match.

As known, microwave energy tends to concentrate at the edges of conductors. Therefore, in the arrangement of FIGS. 3*a* and 4, the current flow attributable to the propagating energy tends to be concentrated along the hypotenuse edges of the vanes of transition 240. Consequently, it is possible to "skeletonize" the vanes.

Figure 5:
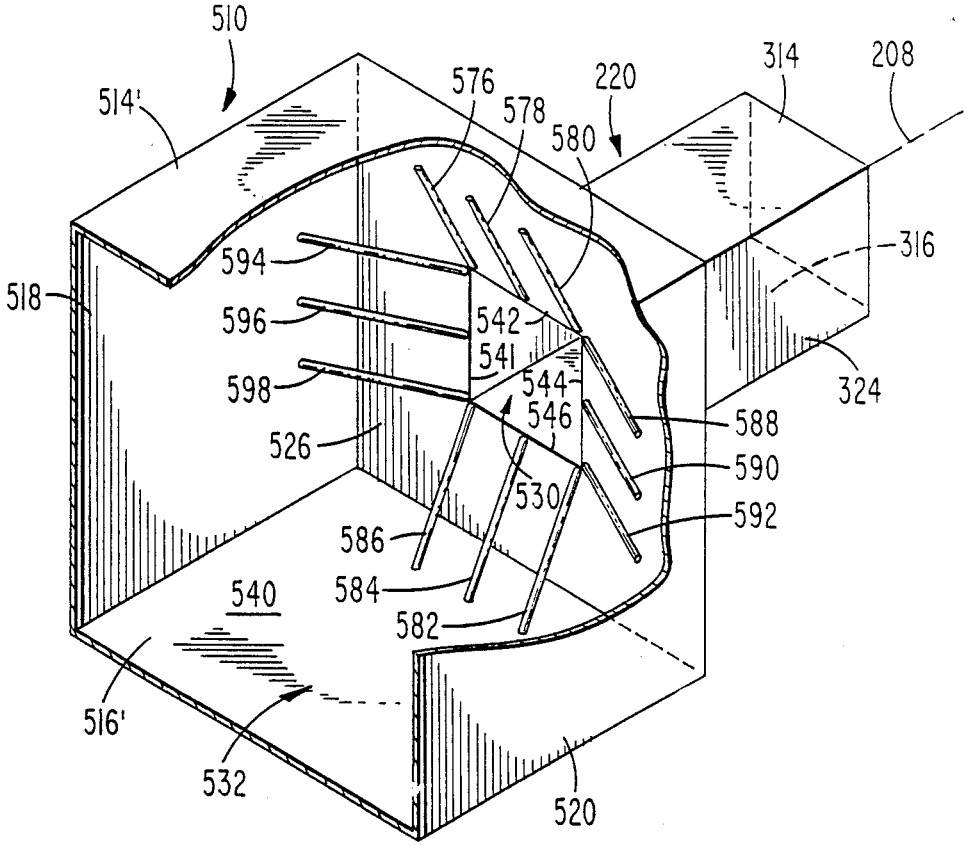
FIG. 5 is a perspective view, partially cut away, of another embodiment of the invention, in which the mode transition is skeletonized into a plurality of elongated conductive strips.

FIG. 5 illustrates an antenna with "skeletonized" vanes and embodying the invention. The arrangement of FIG. 5 is very similar to the arrangement of FIG. 3*a*. Elements of FIG. 5 which are identical to those of FIG. 3*a* are designated by the same reference numerals, and elements corresponding to those of FIG. 3*a* are designated by the same reference numerals, but in the 500 series rather than the 300 series. Thus, box horn 510 of FIG. 5 includes walls 514', 516', 518 and 520. Transition arrangement 540 includes four sets of elongated conductors. A first set of elongated conductors includes conductors 576–580, which are connected between points along upper edge 542 of central aperture 530 and points on side 514' of box horn 510. A second set includes elongated conductors 582–586 extending from points along lower edge 546 of central aperture 530 and points on side 516'. A third set of elongated conductors includes conductors 588–592 extending between right edge 544 of central aperture 530 and points aong wall 520. A fourth set of elongated conductors includes conductors 594–598, which extend from points along left edge 541 of central aperture 530 and points along side 518. The operation of the arrangement of FIG. 5 should be almost indistinguishable from that of the arrangement of FIG. 3*a*.

Figure 6A:
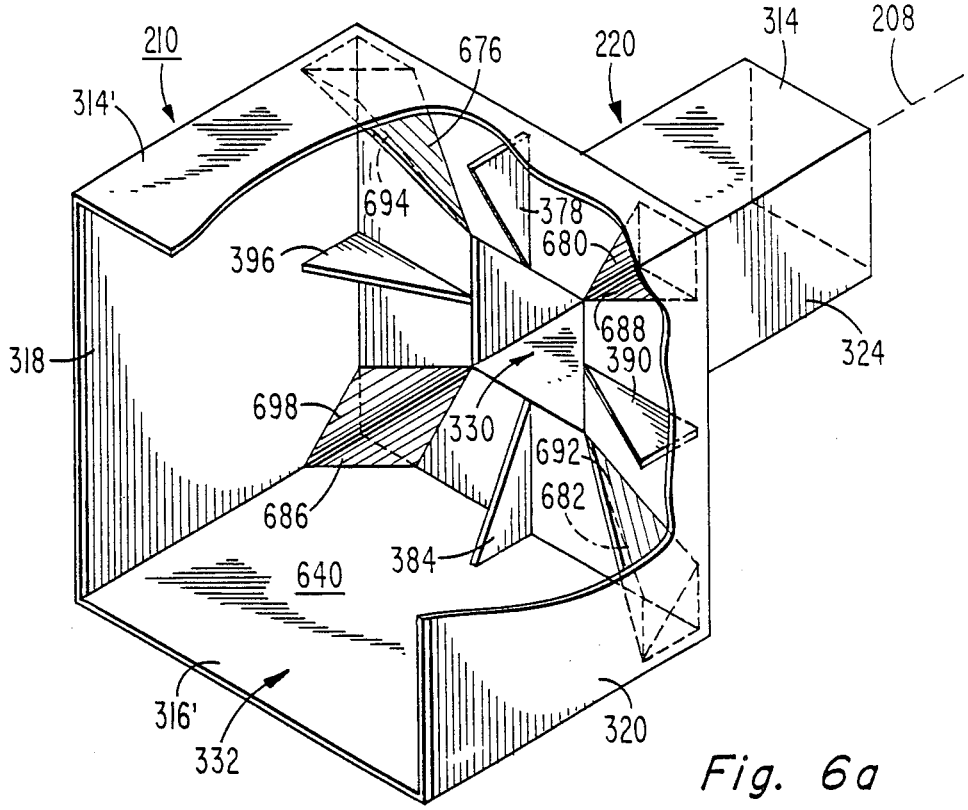
FIG. 6*a* is a perspective view, partially cut away, of another embodiment of the invention similar to that of FIG. 3*a*, with a somewhat different mode trasition.
Figure 6B:
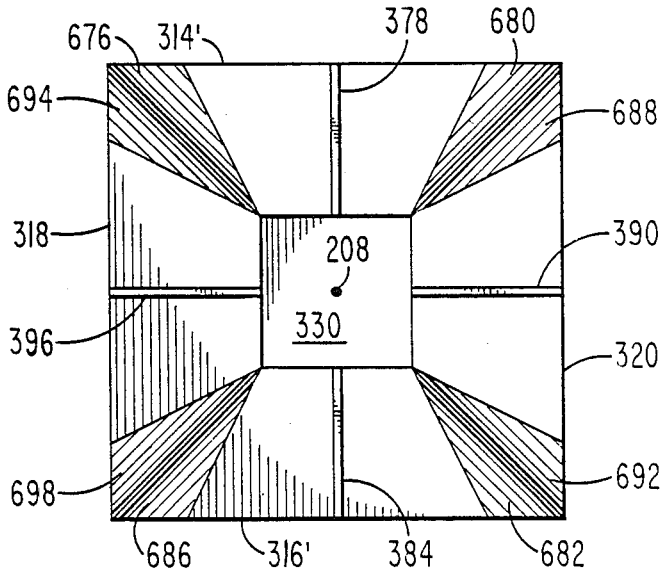
FIG. 6*b* is a view looking into the radiating aperture end of the antenna of FIG. 6.

FIG. 6*a* is a perspective view of another embodiment of the invention. The antenna of FIG. 6*a* is similar to the antenna of FIG. 3*a*, and elements of FIG. 6*a* corresponding to those of FIG. 3*a* are designated by the same reference numerals. In the arrangement of FIG. 6*a*, transition arrangement 640 is similar to transition arrangement 240 of FIG. 3*a*, but treats the corners differently. Transition arrangement 640 includes vanes 378, 384, 390 and 396 which are identical to, and placed identically to the correspondingly-numbered vanes of FIG. 3*a*. Those vanes adjacent the corners of central aperture 330, however, while triangular in shape, are dimensioned somewhat differently, and are oriented slightly differently than in FIG. 3*a*. Consequently, some of the vanes of arrangement 640 have the same reference numerals as vanes of FIG. 3*a*, but in the 600 series rather than the 300 series. In particular, vanes 686 and 698 of FIG. 6*a* are joined together along an edge which extends from the lower left corner of central aperture 330 to a point along the junction of walls 316' and 318. Similarly, vanes 676 and 694 are joined together along an edge, and the line of their joining extends from the upper left corner of central aperture 330 to a point along the junction of walls 314' and 318. Vanes 680 and 688 are joined and the line of their juncture extends from the upper right corner of central aperture 330 to the junction of walls 314' and 320. The juncture of vanes 682 and 692 extend from the lower right corner of central aperture 330 to the junction of walls 316' and 320. FIG. 6*b* is a view looking along axis 208 into radiating aperture 332 of the arrangement of FIG. 6*a*.

Other embodiments of the invention will be apparent to those skilled in the art. In particular, more vanes or fewer vanes may be used along each side of the central aperture than illustrated. Rather than being evenly spaced, the number of vanes in each direction may be proportioned to the density of the electric field at that location. Rather than operating in one of two linear modes, the arrangements may be operated in right-hand or left-hand circular polarization modes, in which the polarization alternates at the same frequency as the frequency of operation. While the described embodiments have interiors which can be described as "hollow" but which are actually filled with air dielectric, the interiors could also be filed with other dielectrics such as plastic foam and still be considered "hollow".

What is claimed is:

1. An antenna, comprising:

a waveguide horn section having a longitudinal axis, said waveguide horn section including first, second, third and fourth conductive elongated planar walls, said first, second, third and fourth planar walls being mutually joined along edges parallel with said axis to define a hollow wave propagating structure having a rectangular cross-section centered on said longitudinal axis, said waveguide horn section being open at a first end and including a second end;

a conductive transition plate coupled to said second end of said waveguide horn section and adapted to be coupled to a feed waveguide having a rectangular cross-section smaller than said rectangular cross-section of said waveguide section, said conductive transition plate being in the form of a rectangle with four sides of a size equal to the size of the sides of said rectangular cross-section of said waveguide horn section, and having a central rectangular aperture including sides, said sides of said rectangular aperture being parallel to said sides of said transition plate, said transition plate being oriented orthogonal to said longitudinal axis with said longitudinal axis passing through the center of said central rectangular aperture, and with each of said four sides of said transition plate in conductive contact with one of said first, second, third and fourth planar walls; and a plurality of substantially planar conductive transition members, each of said transition members having the shape of a triangle with two edges and a hypotenuse edge, each of said transition members being oriented parallel to a plane in which said longitudinal axis lies, each of said transition members being located with one of its edges connected to said transition plate and the other of its edges connected to one of said first, second, third and fourth planar walls, whereby said hypotenuse edge of each of said transition members slopes from a point near said central rectangular aperture to a point along one of said first, second, third and fourth planar walls of said waveguide horn section, at least one of said transition members being associated with each of said first, second, third and fourth planar walls of said waveguide horn section.

2. An antenna according to claim 1, wherein both said waveguide horn section and feed waveguide have square cross-sections, whereby said central rectangular aperture is square, and said first, second, third, and fourth planar walls are of equal width.

3. An antenna according to claim 2, wherein said equal widths of said first, second, third and fourth planar walls of said waveguide section have a dimension greater than or equal to three-halves of a free-space wavelength at a frequency near a design center frequency of operation.

4. An antenna according to claim 1 wherein said plurality equals the product of an integer multiplied by four.

5. An antenna according to claim 4 wherein said integer equals three, whereby said plurality equals twelve, and each of said first, second, third and fourth planar walls of said waveguide section is associated with a set of three of said transition members.

6. An antenna according to claim 5 wherein each of said sets of three transition members includes two end transition members located adjacent a corner of said central aperture, and one transition member located equidistant between said end transition members.

7. An antenna according to claim 1 further comprising four conductive corner transition members, each including two conductive planar walls in the shape of triangles joined together along an edge which extends from a corner of said central rectangular aperture to a point along one of said joined edges parallel with said axis.

* * * * *